US005961129A

United States Patent [19]

Post et al.

[11] Patent Number: 5,961,129

[45] Date of Patent: Oct. 5, 1999

[54] QUICK-RELEASE INTERLOCKING FRAME ASSEMBLY FOR INTERCHANGEABLY MOUNTING OPERATIVE SPORTS DEVICES TO A BOOT SOLE

[76] Inventors: Peter G. Post, 3167 7th St., Boulder, Colo. 80304-2511; Andrew B. Rice, P.O. Box 4205, Boulder, Colo. 80306-4205

[21] Appl. No.: 08/797,095

[22] Filed: Feb. 7, 1997

[51] Int. Cl.[6] ..... A63C 17/18

[52] U.S. Cl. ..... 280/7.13; 280/7.14; 280/11.27; 403/326

[58] Field of Search ..... 280/7.13, 7.14, 280/7.12, 11.27, 11.19, 11.28, 11.3; 36/115; 403/327, 329, 326, 328, 109.3, DIG. 1

[56] References Cited

U.S. PATENT DOCUMENTS

| | | | |
|---|---|---|---|
| 4,114,295 | 9/1978 | Schaefer | 36/100 |
| 4,131,963 | 1/1979 | Johnson | 280/11.3 |
| 4,492,385 | 1/1985 | Olson | 280/7.13 |
| 4,733,682 | 3/1988 | Ellena | 135/69 |
| 4,932,675 | 6/1990 | Olson et al. | 280/7.13 |
| 5,088,749 | 2/1992 | Olivieri | 280/11.18 |
| 5,193,827 | 3/1993 | Olson | 280/7.13 |
| 5,314,199 | 5/1994 | Olson et al. | 280/7.13 |
| 5,320,366 | 6/1994 | Shing | 280/7.14 |
| 5,388,846 | 2/1995 | Gierveld | 280/11.22 |
| 5,507,506 | 4/1996 | Shadroui | 280/11.22 |
| 5,531,462 | 7/1996 | Gu | 280/7.13 |
| 5,735,536 | 4/1998 | Myers et al. | 280/7.13 |

FOREIGN PATENT DOCUMENTS 510384 10/1992 European Pat. Off. .

*Primary Examiner*—Lanna Mai
*Assistant Examiner*—Avraham H. Lerner
*Attorney, Agent, or Firm*—Emery L. Tracy

[57] ABSTRACT

A quick-release interlocking frame assembly for interchangeably and operatively mounting at separate times in-line skate rollers and an ice skate blade to a boot sole, includes a first base attachable to a toe portion of a boot sole, a second base attachable to a heel portion of the boot sole, a first pair of spaced flanges attached on the first base and defining a first channel therebetween, a second pair of spaced flanges attached on the second base and defining a second channel therebetween, a first bracket operatively supporting inline skate rollers, a second bracket operatively supporting an ice skate blade, a pair of first platforms each attached on a forward portion of respective ones of the first and second brackets and being adapted to slidably fit within the first channel between the first pair of flanges on the first base, a pair of second platforms each attached on a rearward portion of respective ones of the first and second brackets and being adapted to slideably fit within the second channel between the second pair of flanges on the second base, and finger pressure actuatable elements defined on selected ones of the first and second platforms and the first and second pairs of flanges for releasably interlocking the selected one platforms to the selected one pairs of flanges.

17 Claims, 2 Drawing Sheets

QUICK-RELEASE INTERLOCKING FRAME ASSEMBLY FOR INTERCHANGEABLY MOUNTING OPERATIVE SPORTS DEVICES TO A BOOT SOLE

BACKGROUND OF THE INVENTION

1. Field of the Invention

The present invention generally relates to sports and recreational equipment and, more particularly, is concerned with a quick-release interlocking frame assembly for interchangeably mounting at separate times operative sports devices, such as in-line skate rollers and an ice skate blade, to a boot sole.

2. Description of the Prior Art

Skates, both ice and roller, have long been popular sports and recreational equipment. Generally, each skate includes an operative sports device, such as an ice skate blade and an in-line skate roller assembly, which enables the skater to glide upon a supporting surface such as ice or a sidewalk, and a boot which fits the foot of the skater and mounts the operative sports device of the skate. Historically, the operative sports device of the skate has been permanently fastened to the bottom or sole of the boot. Even though in the case of both ice skates and in-line roller skates, for instance, the boot serves the same function, separate skates have been provided.

In recent years, different designs for convertible skates have been proposed in an attempt to afford the selective attachment of either an ice skate blade or an in-line skate roller assembly to the same boot and thus eliminate the requirement and expense for separate boots with the different operative sports devices. Some designs representative of prior art skates having interchangeable ice skate blades and roller assemblies are disclosed in U.S. Pat. No. 4,114,295 to Schaefer, U.S. Pat. No. 4,492,385 to Olson, U.S. Pat. No. 5,088,749 to Olivieri, U.S. Pat. No. 5,193,827 to Olson, U.S. Pat. No. 5,314,199 to Olson et al, U.S. Pat. No. 5,320,366 to Shing, U.S. Pat. No. 5,388,846 to Gierveld and U.S. Pat. No. 5,531,462 to Gu.

However the interchangeable assemblies of these patents appear to have one or more of the following drawbacks: (1) a tool is required to remove and replace the different sports devices to and from their boot mounting frames; (2) separate parts, such as coupling nuts and bolts, are required to achieve secure and locked connections between the mounting frames and different sports devices; (3) a condition of quick-releasability between the different sports devices and mounting frames is not achieved in view that multiple operations are required to make the necessary connections between the mounting frames and different sports devices; and (4) coupling arrangements between the different sports devices and the boot mounting frames leave the sports devices vulnerable to accidential disengagement from the mounting frames.

Consequently, a need continues to exist for a frame assembly which overcomes the aforementioned drawbacks in the prior art without introducing any new drawbacks in place thereof.

SUMMARY OF THE INVENTION

The present invention provides a quick-release interlocking frame assembly designed to satisfy the aforementioned need. The quick-release interlocking frame assembly of the present invention is adapted to interchangeably and operatively mount at separate times sports devices, such as in-line skate rollers and an ice skate blade, to a boot sole without the use of tools and extra parts and in a locked and securely fitted manner that substantially eliminates the risk of accidental release.

Accordingly, the present invention is directed to a quick-release interlocking frame assembly for mounting a sports device on a sole of a boot sole. The quick-release interlocking frame assembly comprises: (a) a first base attachable to a toe portion of a boot sole; (b) a second base attachable to a heel portion of the boot sole; (c) a first pair of spaced flanges attached on the first base and defining a first channel therebetween; (d) a second pair of spaced flanges attached on the second base and defining a second channel therebetween; (e) a bracket operatively supporting a sports device; (f) a first platform attached on a forward portion of the bracket and being adapted to slidably fit within the first channel between the first pair of flanges on the first base; (g) a second platform attached on a rearward portion of the bracket and being adapted to slideably fit within the second channel between the second pair of flanges on the second base; and (h) a plurality of finger pressure actuatable elements defined on a selected one of the first and second platforms and a selected one of the first and second pairs of flanges for releasably interlocking the selected one platform to the selected one pair of flanges. The pairs of side flanges together with respective ones of the toe and heel bases form opposing recessed cavities along opposite sides of the respective channels which receive opposite side edge portions of respective ones of the platforms as the platforms are slidably inserted into the channels.

More particularly, the plurality of finger pressure actuatable elements include a pair of slots each formed through one of the side flanges of the selected one pair thereof and a pair of latch members mounted to a respective one of the first and second platforms for undergoing movement toward and away from one another relative to the respective side flanges of the selected one pair thereof, the latch members having respective outer ends defining latch protrusions moved between retracted unlatched positions and extended latched positions relative to the slots. The latch members are thus mounted to move inwardly toward one another to dispose their latch protrusions at unlatched positions away from the slots of the selected one pair of side flanges and thereby permit insertion of the selected one platform into the channel with opposite sides of the one platform disposed adjacent to the selected one pair of side flanges. Also, the latch members are thus mounted to move outwardly away from one another to dispose their latch protrusions at latched positions beyond the opposite sides of the selected one platform extending into the slots in the side flanges of the selected one pair thereof when the selected one platform is fully inserted within the channel of the selected one pair of side flanges.

The aforementioned finger pressure actuatable elements of the interlocking frame assembly provide a true quick-release capability in that it only requires the performance of a single manual operation using one of the hands of the user to accomplish the connection or disconnection. The single manual operation is performed by the squeezing of the pair of latch members of the frame assembly toward one another through a distance sufficient to allow clearance of the latch protrusions on the latch members relative to slots formed in the frame assembly to allow connection or disconnection of sports device supporting portions of the frame assembly to or from other portions thereof that are attached to the heel sole.

Thus, the latch members can be actuated by being squeezed together using the fingers of a single hand of the user. When the latch members are squeezed together, their latch protrusions are moved toward one another within the width of the channel and thus removed from the slots in the side flanges. When the platform carrying the latch members becomes fully slidably inserted within the channel, the latch protrusions on the pair of latch members will move away from one another and extend into the slots, making a click sound as they are brought into alignment with the slots. However, the latch protrusions do not extend beyond the exterior or outside surfaces of the side flanges. Thus, outer edges of the latch protrusions at most will lie flush with the exterior surfaces of the side flanges and not be subjected to catching an external object that could force the latch protrusions inwardly and dislodge them from the slots and permit accidental release of the platforms from the toe and heel bases. Furthermore, because the latch protrusions are exposed through slots of the side flanges which are located at opposite sides of the platform, two engagements or impacts with the latch protrusions would have to occur substantially simultaneously at the opposite sides of the platform and from opposite directions in order to contact and accidentally dislodge the two latch protrusions from the slots.

Also, the present invention is directed to a quick-release interlocking frame assembly for interchangeably and operatively mounting sports devices on a boot sole. The quick-release interlocking frame assembly comprises: (a) a first base attachable to a toe portion of a boot sole; (b) a second base attachable to a heel portion of the boot sole; (c) a first pair of spaced flanges attached on the first base and defining a first channel therebetween; (d) a second pair of spaced flanges attached on the second base and defining a second channel therebetween; (e) a first bracket operatively supporting a first sports device, such as an ice skate blade; (f) a second bracket operatively supporting a second sports device, such as in-line skate rollers; (g) a pair of first platforms each attached on a forward portion of respective ones of the first and second brackets and being adapted to slidably fit within the first channel between the first pair of flanges on the first base; (h) a pair of second platforms each attached on a rearward portion of respective ones of the first and second brackets and being adapted to slideably fit within the second channel between the second pair of flanges on the second base; and (i) a plurality of finger pressure actuatable elements defined on selected ones of the first and second platforms and selected ones of the first and second pairs of flanges for releasably interlocking the selected one platforms to the selected ones of the pairs of flanges.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
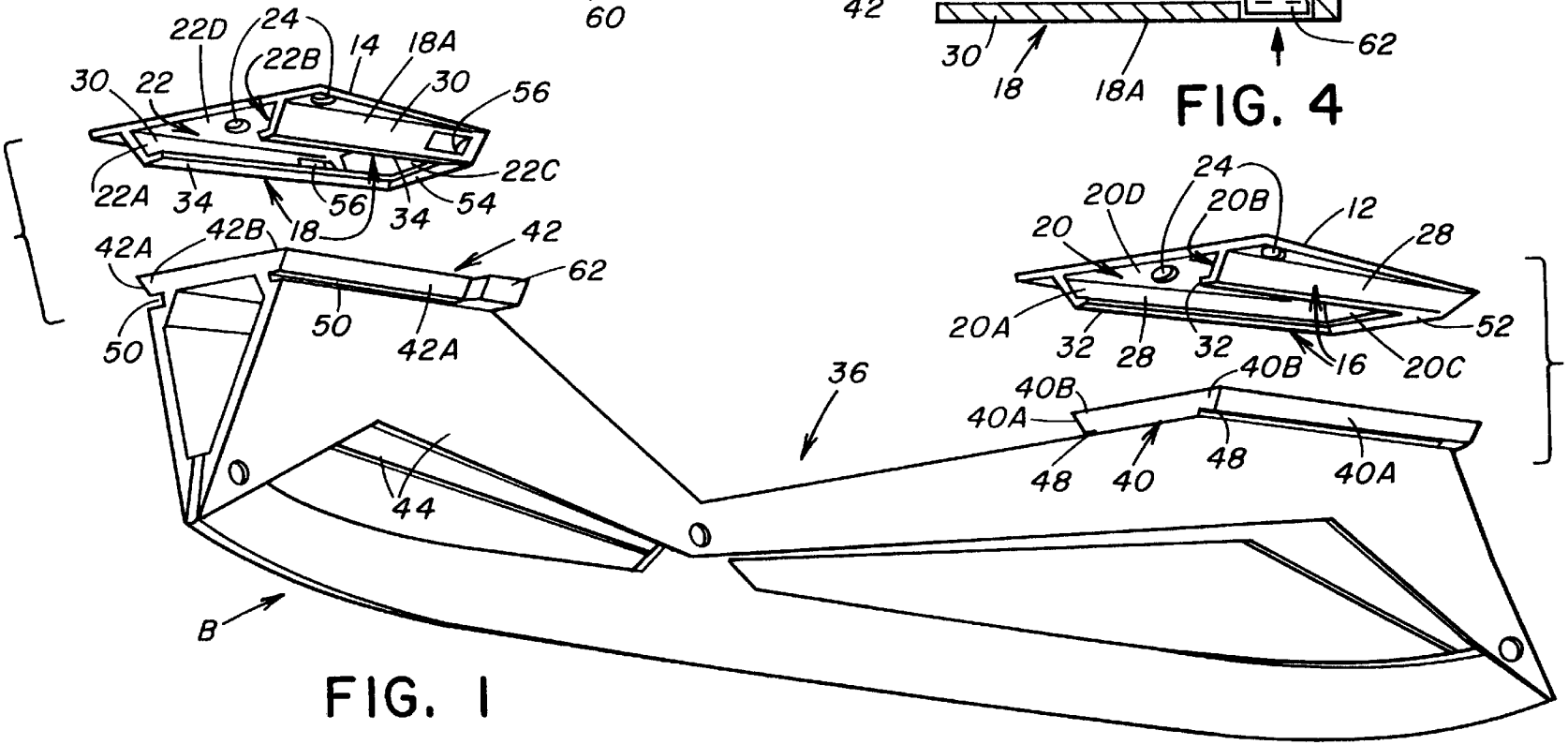
FIG. 1 is an exploded perspective view of a quick-release interlocking frame assembly of the present invention for interchangeably mounting at separate times operative sports devices to the sole of a boot, the frame assembly being shown in association with an ice skate blade.
Figure 2:
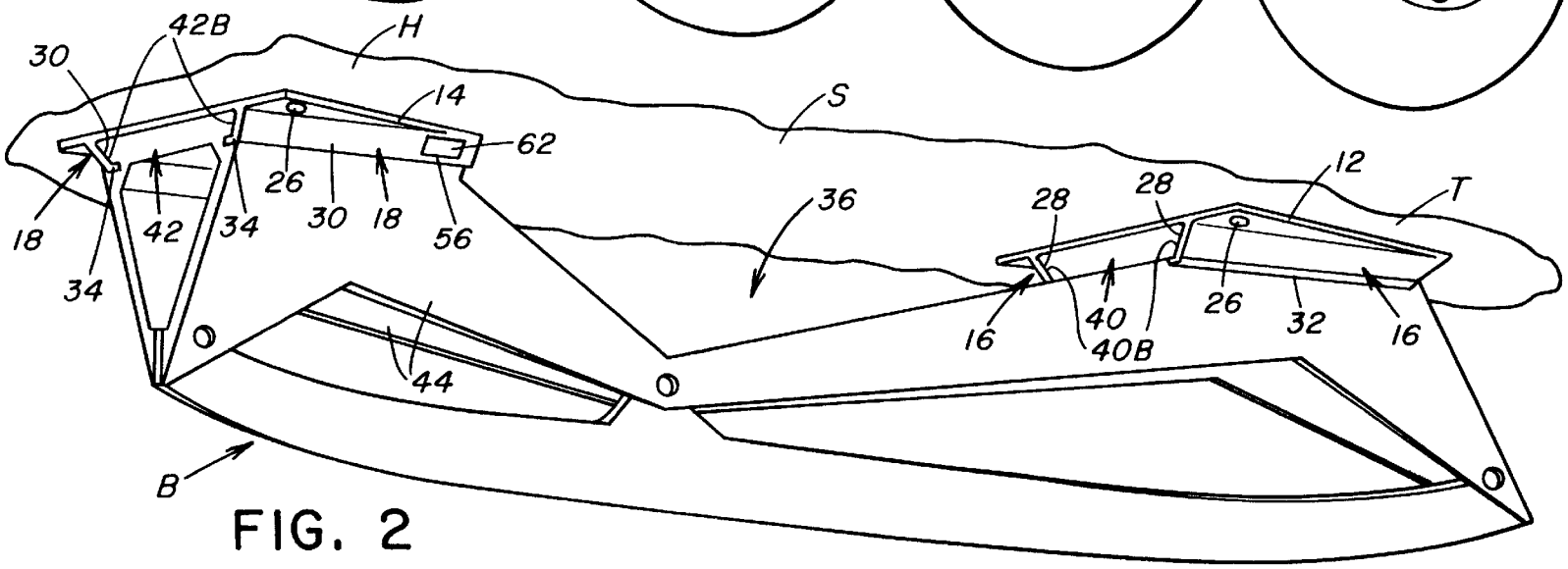
FIG. 2 is a perspective view of the frame assembly shown with the ice skate blade.

Referring to the drawings, and particularly to FIGS. 1 and 2, there is illustrated a quick-release interlocking frame assembly of the present invention, generally designated 10. The frame assembly 10 is adapted to operatively and interchangeably mount sports devices, preferably (although not necessarily) in-line skate rollers R and an ice skate blade B on a sole S of a boot.

Figure 3:
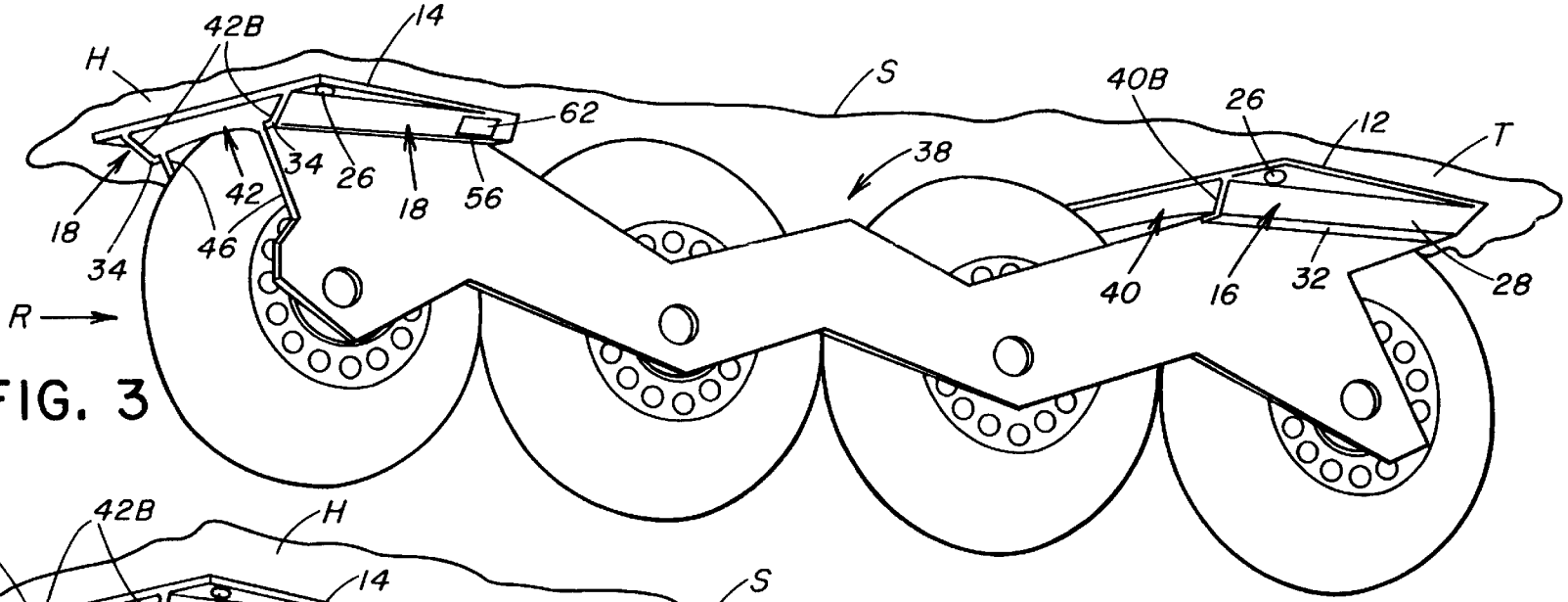
FIG. 3 is a perspective view of the frame assembly shown with in-line skate rollers.

Referring to FIGS. 1–3, the frame assembly 10 includes toe and heel bases 12, 14 attachable respectively to toe and heel portions T, H of the boot sole S, and first connector parts in the form of first and second pairs of spaced side flanges 16, 18 attached on the toe and heel bases 12, 14 and defining first and second channels 20, 22 therebetween. The toe and heel bases 12, 14 can take the form of generally flat plates that will lie flush against the toe and heel portions T, H of the boot sole S and have two or more apertures 24 therethrough for receiving fasteners 26, such as rivets, to attach the flat plates or bases 12, 14 to the toe and heel portions T, H of the shoe sole S.

The side flanges 16, 18 of the first and second pairs thereof respectively include narrow walls 28, 30 that may converge toward one another as they extend from the bases 12, 14. The side flanges 16, 18 also include bottom lips 32, 34 respectively attached on lower ends of the walls 28, 30 so as to extend toward one another. Also, the side flanges 16, 18 of the first and second pairs thereof may extend substantially parallel to one another. Preferably, although not necessarily, each pair of side flanges 16, 18 is integrally connected to its respective one of the toe and heel bases 12, 14 and they can be fabricated using conventionally known techniques from any suitable material, such as various well-known metals, for example aluminum, magnesium, titanium, etc., or plastics.

Referring to FIGS. 1–4, the frame assembly 10 also includes first and second brackets 36, 38 operatively supporting the ice skate blade B and in-line skate rollers R, respectively. Further, the frame assembly 10 includes second connector parts, being complementary in shape to the aforementioned first connector parts, in the form of first and second pairs of beams or platforms 40, 42 attached to the first and second brackets 36, 38, respectively. Preferably, although not necessarily, each pair of platforms 40, 42 is integrally connected to respective ones of the brackets 36, 38 and they can be fabricated using conventionally known techniques from any suitable material, such as various well-known metals or plastics.

The first and second brackets 36, 38 include respective first and second pairs of side bracket members 44, 46 which respectively extend longitudinally between and attach to the first and second platforms 40, 42. The side bracket members 44, 46 have longitudinally spaced upper portions where they are respectively attached to the first and second platforms 40, 42 and also have spaced apart lower portions where they are adapted to receive and support the ice skate blade B and the in-line skate rollers R therebetween. The first pair of side bracket members 44 of the first bracket 36 extend in converging relationship from the upper portions to the lower portions thereof, whereas the second pair of side bracket members 46 of the second bracket 38 extend in substantially parallel relationship to one another.

The first platforms 40 are each attached on a forward portion of respective ones of the first and second brackets 36, 38 and are adapted to slidably fit at separate times within the first channel 20 between the first pair of side flanges 16 on the toe base 12. The second platforms 42 are each attached on a rearward portion of respective ones of the first and second brackets 36, 38 and are adapted to slideably fit at separate times within the second channel 22 between the second pair of side flanges 14 on the heel base 14. The platforms 40, 42 each has opposite sides with exterior surfaces 40A, 42A that converge toward one another in conformity with the convergence of the walls 28, 30 of the side flanges 16, 18 toward one another. The walls 28, 30 and lips 32, 34 of the respective pairs of side flanges 16, 18 together with respective ones of the toe and heel bases 12, 14 form opposing and facing recessed cavities 20A, 20B and 22A, 22B at opposite sides of the respective channels 20 and 22 which receive opposite side edge portions 40B, 42B of respective ones of the platforms 40, 42 as the platforms 40, 42 are slidably inserted into the channels 20, 22 of the respective pairs of side flanges 16, 18. Also, the platforms 40, 42 have respective grooves 48, 50 formed in their exterior surfaces at their opposite sides that slidably receive the bottom lips 32, 34 on the walls 28, 30 of the side flanges 16, 18 as the respective platforms 40, 42 are slidably inserted into the channels 20, 22.

Furthermore, the first complementary connector parts on the toe and heel bases 12, 14 include an end flange 52, 54 associated with each pair of side flanges 16, 18. Each end flange 52, 54 extends between and is attached at opposite ends to respective ones of the first and second pairs of side flanges 16, 18 so as to close an anterior end 20C, 22C of the respective ones of the first and second channels 20, 22 defined between the respective pairs of side flanges 16, 18 being opposite from an open posterior end 20D, 20D thereof and thus function as respective end stops blocking over-insertion of the platforms into the respective channels 20, 22.

Finally, the frame assembly 10 includes a plurality of finger pressure actuatable elements provided on selected ones of the first and second platforms 40, 42 and selected ones of the first and second pairs of side flanges 16, 18 for releasably interlocking the selected one platforms 40, 42 to the selected ones of the pairs of side flanges 16, 18. Whereas the actuatable elements can be provided on all of the platforms 40, 42 and side flanges 16, 18, that is not necessary and would only unduly complicate the unlatching of the respective components from one another by requiring the use of both hands of the user. For purposes of illustration, the selected ones of the platforms 40, 42 and side flanges 16, 18 are the second pair of platforms 42 associated with the rearward portions of the brackets 36, 38 and the second pair of side flanges 18 associated with the heel base 14.

More particularly, the finger pressure actuatable elements basically include a pair of slots 56 each being formed through a respective one of the second side flanges 18 adjacent to the anterior end 22A of the second channel 22, and a pair of latch members 58 mounted to the second platform 42 for undergoing movement toward and away from one another relative to the respective second side flanges 18. The latch members 58 have respective outer ends defining latch protrusions 60 which are moved between retracted unlatched positions and extended latched positions relative to the slots, as seen in broken and solid line forms in FIG. 4. The latch members 58 are thus adapted to be moved inwardly toward one another to dispose their respective latch protrusions 60 at unlatched positions away from the slots 56 of the second side flanges 18 and thereby permit insertion of the second platform 42 into the channel 22 between the side flanges 18 with opposite sides of the platform 42 disposed adjacent to the side flanges 18. Also, the latch members 58 are thus adapted to be moved outwardly away from one another to dispose their latch protrusions 60 at latched positions beyond the opposite sides of the platform 42 and extending into the slots 56 in the side flanges 18 when the platform 42 has been fully inserted within the channel 22.

Figure 4:
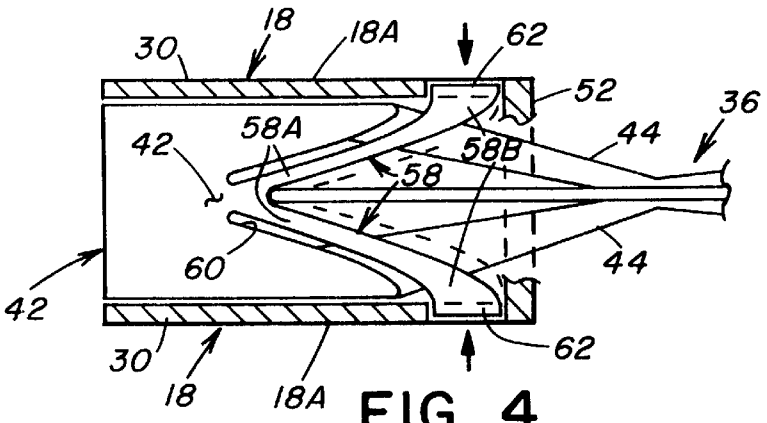
FIG. 4 is an enlarged top plan view, with portions in section, of the frame assembly taken along line 4—4 of FIG. 2 showing one embodiment of finger pressure actuatable elements that can be employed for releasably interlocking the different sports devices to the boot sole.

The latch members 58 can be implemented by several different embodiments thereof. Referring to one embodiment thereof shown in FIGS. 1–4, the latch members 58 are in the form of a pair of resiliently flexible and yieldable spring latch arms 58 attached to the respective second platform 42. As best seen in FIG. 4, in the one embodiment each second platform 42 has a generally V-shaped cavity 62 extending from an anterior end 42A of the second platform 42 to approximately the middle thereof. The arms 58 at inner ends 58A thereof are preferably, although not necessarily, integrally attached to the platform 42 at such middle location 42C thereof and extend therefrom to outer ends 58B defining the latch protrusions 60 which with the arms 58 in an unflexed condition extend outwardly beyond the exterior side surfaces 42A and forwardly beyond the anterior end of the platform 42. Thus, in the relaxed or unflexed condition of the arms 58 shown in solid line form in FIG. 4, their latch protrusions 60 extend through the slots 56 and assume latched positions when the platform 42 is fully inserted in the second channel 22 of the side flanges 18 on the heel base 14. The spring latch arms 58 are adapted to be squeezed and flexed inwardly toward one another as shown in dashed line form in FIG. 4 to dispose their latch protrusions 60 at unlatched positions away from the slots 56 of the side flanges 18 and thereby permit the insertion and removal of the platform 42 into and from the second channel 22 with the opposite exterior side surfaces 42A of the platform 42 disposed closely adjacent to the side flanges 18. Release of the spring latch arms 58 allows them to flex back outwardly away from one another and to return their latch protrusions 60 to the latched positions within the slots 56 in the side flanges 18 when the platform 42 is inserted within the second channel 22 between the side flanges 18.

Figure 5:
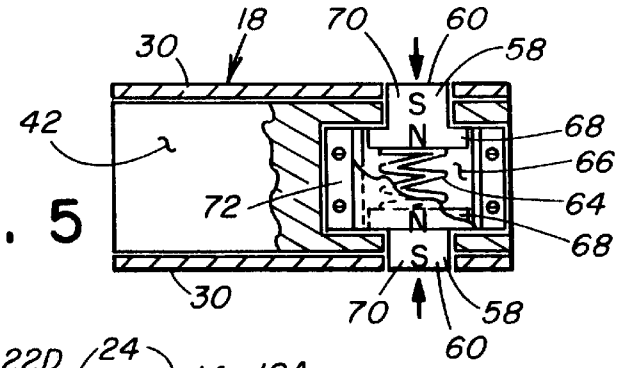
FIG. 5 is a top plan view, with portions broken away and in section, showing another embodiment of finger pressure actuatable elements that can be employed for releasably interlocking the different sports devices to the boot sole.

Referring to FIG. 5, there is shown another embodiment of the latch members 58 of the finger pressure actuatable elements in the form of a pair of push buttons 58 and a compressible spring 64 mounted in a cavity 66 formed in the second platform 42 and disposed between the push buttons 58. The push buttons 58 have inner bases 68 of cross-sectional widths greater than those of the slots 46 and of passages 42D through the side edge portions 42B of the second platforms 42 and outer heads 70 attached to and extending outwardly from the bases 68 and are of cross-sectional widths less than those of the slots 56 and passages 42D. A cover 72 fastened on the platform 42 within the cavity 66 overlies the push buttons 58 and spring 64, retaining them therein. The compressible spring 64 normally forces the push buttons 58 away from one another such that their outer heads 70 which define the latch protrusions 60 normally extend through the aligned slots 56 and passages 42D to the latched positions when the platform 42 is in the fully inserted position shown in FIG. 5. By the user applying a squeezing force to both push buttons 58, the resistance of the spring 64 can be overcome and permit the push buttons 58 to move toward one another to the unlatched positions which allow insertion or withdrawal of the platform 42 into or from the channel 22 between the side flanges 18. As an alternative, the spring 64 can be eliminated and the push buttons 58 can be made of permanent magnetic material wherein their respective bases 68 are like poles, as is shown in FIG. 5. Thus, the like poles of the bases 68 which repel one another will normally hold the push buttons 58 at the extended latched positions relative to one another. An inward squeezing force can be applied to both push buttons 58 that will temporarily overcome the magnetic repulsion force sufficiently to allow insertion or removal of the platform 42.

Therefore, the interlocking frame assembly 10 incorporates a true quick-release capability in that it only requires the performance of a single manual operation using one of the hands of the user to accomplish the connection or disconnection. The single manual operation is performed by the squeezing of the pair of latch members 58 toward one another through a distance sufficient to allow clearance of their latch protrusions 60 relative to the slots 56 formed in the side flanges 18 on the heel base 14 and permit either connection or disconnection of the respective bracket 36, 38 to or from the heel base 14.

To reinterate, the latch members 58 can be actuated by being squeezed together using the fingers of a single hand of the user. When the latch members 58 are squeezed together, their latch protrusions 60 are moved toward one another to within the width of the channel 22 and thus removed from the slots 56 in the side flanges 18. When the platform 42 becomes fully slidably inserted within the channel 22, the pair of latch members 58 will return to the relaxed or unflexed condition and their latch protrusions 60 will automatically move away from one another and extend into the slots 56, making a click sound as they are brought into alignment with the slots 56. However, the latch protrusions 60 do not extend beyond the exterior or outside surfaces 18A of the side flanges 18. Thus, outer edges of the latch protrusions 60 at most will lie flush with the exterior surfaces 18A of the side flanges 18 and not be subjected to catching an external object that could force the latch protrusions 60 inwardly and dislodge them from the slots 56 and permit accidental release of the platforms 40, 42 from the toe and heel bases 12, 14. Furthermore, because the latch protrusions 60 are exposed through slots 56 of the side flanges 18 which are located at opposite sides of the platform 42, two engagements or impacts with the latch protrusions 60 would have to occur substantially simultaneously at the opposite sides of the platform 42 and from opposite directions in order to contact and accidentally dislodge the two latch protrusions 60 from the slots 56. The likelihood of this happening, if not non-existant, appears to be very remote indeed. The platforms 40, 42 are sized relative to the channels 20, 22 to slidably fit therein with such close clearances as to provide a secure and stable fit that allows only such minimal play between them that does not adversely affect the operation and use of the sports devices supported by the frame assembly 10. The bottoms of the channels 20, 22 are open for allowing passage of the brackets 36, 38 therethrough. The platforms 40, 42 having upper surfaces which make flush contact with the undersurfaces of the toe and heel bases 12, 14.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A quick-release interlocking frame assembly operatively mounting a sports device on a boot sole, said frame assembly comprising:

(a) a first base attachable to a toe portion of a boot sole;

(b) a second base attachable to a heel portion of the boot sole;

(c) a first pair of spaced side flanges attached on said first base and defining a first channel therebetween;

(d) a second pair of spaced side flanges attached on said second base and defining a second channel therebetween;

(e) a bracket operatively supporting a sports device;

(f) a first platform attached on a forward portion of said bracket and being adapted to slidably fit within said first channel between said first pair of side flanges on said first base;

(g) a second platform attached on a rearward portion of said bracket and being adapted to slideably fit within said second channel between said second pair of side flanges on said second base; and (h) a plurality of finger pressure actuatable elements defined on a selected one of said first and second platforms and a selected one of said first and second pairs of side flanges for releasably interlocking said selected one platform to said selected one pair of side flanges said plurality of finger pressure actuatable elements including a pair of slots each being formed through one of said selected one platform side flanges of said selected one pair thereof and a pair of latch members mounted to said selected one platform for undergoing movement toward and away from one another relative to said selected one pair of side flanges, said latch members having respective outer ends defining latch protrusions which are moved between retracted unlatched positions and extended latched positions relative to said slots to thereby respectively dispose said latch protrusions away from said slots to permit insertion of said latch protrusions into said channel between said side flanges and extending into said slots in said side flanges when said platform has been fully inserted within said channel, further wherein said pair of latch members is a pair of resiliently flexible and yieldable spring latch arms attached at inner ends to said selected one platform and extending therefrom to outer ends defining latch protrusions adapted to extend through said slots, said spring latch arms being adapted to flex inwardly toward one another to dispose said latch protrusions at unlatched positions away from said slots of said selected one pair of side flanges and thereby permit insertion of said selected one platform into said channel with opposite sides of said one platform disposed adjacent to said selected one pair of side flanges, and said spring latch arms being adapted to flex outwardly away from one another to dispose said latch protrusions at latched positions beyond said opposite sides of said selected one platform extending into said slots in said side flanges of said selected one pair thereof when said selected one platform is inserted within said channel of said selected one pair of side flanges.

2. The assembly of claim 1 wherein said pairs of side flanges together with respective ones of said toe and heel bases form opposing recessed cavities along opposite sides of said respective channels which receive opposite side edge portions of respective ones of said platforms as said platforms are slidably inserted into said respective channels.

3. The assembly of claim 1 wherein:

said side flanges include walls that converge toward one another; and said platforms have opposite sides with surfaces that converge toward one another in conformity with the convergence of said walls of said side flanges toward one another.

4. The assembly of claim 3 wherein:

said flanges include lips on said walls that extend toward one another; and said platforms have grooves formed in said surfaces of said opposite sides that receive said lips on said walls of said side flanges as said platform is slidably inserted into said channel of a respective one of said pair of side flanges.

5. The assembly of claim 1 wherein said bases have at least two apertures therethrough for receiving fasteners for attaching said bases to the heel and toe portions of the boot sole.

6. The assembly of claim 1 further comprising:

first and second end flanges, said first end flange extending between and attached to said side flanges of said first pair thereof so as to close and provide a stop at an end of said first channel therebetween, said second end flange extending between and attached to said side flanges of said second pair thereof so as to close and provide a stop at an end of said second channel.

7. The assembly of claim 1 wherein said bracket includes a pair of side bracket members extending longitudinally between said first and second platforms, said side bracket members having longitudinally spaced upper portions attached to said first and second platforms and spaced apart lower portions adapted to receive the sports device therebetween, said side bracket members extending in converging relationship from said upper portions to said lower portions thereof.

8. The assembly of claim 1 wherein said bracket includes a pair of side bracket members extending longitudinally between said first and second platforms, said side bracket members having longitudinally spaced upper portions attached to said first and second platforms and spaced apart lower portions adapted to receive the sports device therebetween, said side bracket members extending in substantially parallel relationship to one another.

9. A quick-release interlocking frame assembly interchangeably and operatively mounting sports devices on a boot sole, said frame assembly comprising:

(a) a first base attachable to a toe portion of a boot sole;

(b) a second base attachable to a heel portion of the boot sole;

(c) a first pair of spaced side flanges attached on said first base and defining a first channel therebetween;

(d) a second pair of spaced side flanges attached on said second base and defining a second channel therebetween;

(e) a first bracket operatively supporting a first sports device;

(f) a second bracket operatively supporting a second sports device;

(g) a pair of first platforms each attached on a forward portion of respective ones of said first and second brackets and being adapted to slidably fit within said first channel between said first pair of side flanges on said first base;

(h) a pair of second platforms each attached on a rearward portion of respective ones of said first and second brackets and being adapted to slideably fit within said second channel between said second pair of side flanges on said second base; and (i) a plurality of finger pressure actuatable elements defined on selected ones of said first and second platforms and selected ones of said first and second pairs of side flanges for releasably interlocking said selected one platforms to said selected ones of said pairs of side flanges, wherein said plurality of finger pressure actuatable elements include a pair of slots each being formed through one of said side flanges of said selected one pair thereof and a pair of latch members mounted to said selected one platform for undergoing movement toward and away from one another relative to said selected one pair of side flanges, said latch members having respective outer ends defining latch protrusions which are moved between retracted unlatched positions and extended latched positions relative to said slots to thereby respectively dispose said latch protrusions away from said slots to permit insertion of said into said channel between said side flanges and extending into said slots in said side flanges when said platform has been fully inserted within said channel and further wherein said pair of latch members is a pair of resiliently flexible and yieldable spring latch arms attached at inner ends to said selected one platform and extending therefrom to outer ends defining latch protrusions adapted to extend through said slots, said spring latch arms being adapted to flex inwardly toward one another to dispose said latch protrusions at unlatched positions away from said slots of said selected one pair of side flanges and thereby permit insertion of said selected one platform into said channel with opposite sides of said one platform disposed adjacent to said selected one pair of side flanges, and said spring latch arms being adapted to flex outwardly away from one another to dispose said latch protrusions at latched positions beyond said opposite sides of said selected one platform extending into said slots in said side flanges of said selected one pair thereof when said selected one platform is inserted within said channel of said selected one pair of side flanges.

10. The assembly of claim 9 wherein said pairs of side flanges together with respective ones of said toe and heel bases form opposing recessed cavities along opposite sides of said respective channels which receive opposite side edge portions of respective ones of said platforms as said platforms are slidably inserted into said respective channels.

11. The assembly of claim 9 wherein:

said side flanges includes walls that converge toward one another; and said platforms have opposite sides with surfaces that converge toward one another in conformity with the convergence of said walls of said side flanges toward one another.

12. The assembly of claim 11 wherein:

said flanges include lips on said walls that extend toward one another; and said platforms have grooves formed in said surfaces of said opposite sides that receive said lips on said walls of said side flanges as said platform is slidably inserted into said channel of a respective one of said pair of side flanges.

13. The assembly of claim 9 wherein said bases have at least two apertures therethrough for receiving fasteners for attaching said bases to the heel and toe portions of the shoe sole.

14. The assembly of claim 9 further comprising:

first and second end flanges, said first end flange extending between and attached to said side flanges of said first pair thereof so as to close and provide a stop at an end of said first channel therebetween, said second end flange extending between and attached to said side flanges of said second pair thereof so as to close and provide a stop at an end of said second channel.

15. The assembly of claim 9 wherein said first bracket includes a pair of side bracket members extending longitudinally between said platforms of said first pair thereof, said side bracket members having longitudinally spaced upper portions attached to said platforms of said first pair thereof and spaced apart lower portions adapted to receive the first sports device therebetween, said side bracket members extending in converging relationship from said upper portions to said lower portions thereof.

16. The assembly of claim 9 wherein said second bracket includes a pair of side bracket members extending longitudinally between said platforms of said second pair thereof, said side bracket members having longitudinally spaced upper portions attached to said platforms of said second pair thereof and spaced apart lower portions adapted to receive the second sports device therebetween, said side bracket members extending in substantially parallel relationship to one another.

17. A quick-release interlocking frame assembly interchangeably and operatively mounting in-line skate rollers and an ice skate blade on a boot sole, said frame assembly comprising:

(a) a first base attachable to a toe portion of a boot sole;

(b) a second base attachable to a heel portion of the boot sole;

(c) a first pair of spaced side flanges attached on said first base and defining a first channel therebetween;

(d) a second pair of spaced side flanges attached on said second base and defining second channel therebetween;

(e) a first bracket operatively supporting inline skate rollers;

(f) a second bracket operatively supporting an ice skate blade;

(g) a pair of first platforms each attached on a forward portion of respective ones of said first and second brackets and being adapted to slidably fit within said first channel between said first pair of side flanges on said first base;

(h) a pair of second platforms each attached on a rearward portion of respective ones of said first and second brackets and being adapted to slideably fit within said second channel between said second pair of side flanges on said second base; and (i) a plurality of finger pressure actuatable elements defined on selected ones of said first and second platforms and ones of said first and second pairs of side flanges for releasably interlocking said selected one platforms to said selected ones of said pairs of side flanges wherein said plurality of finger pressure actuatable elements include a pair of slots each being formed through one of said side flanges of said selected one pair thereof and a pair of resiliently flexible and yieldable spring latch arms attached at inner ends to said selected one platform and extending therefrom to outer ends defining latch protrusions adapted to extend through said slots with said spring latch arms being adated to flex inwardly toward one another to dispose said latch protrusions at unlatched positions away from said slots of said selected one pair of side flanges and thereby permit insertion of said selected one platform into said channel with opposite sides of said one platform disposed adjacent to said selected one pair of side flanges, and said spring latch arms being adapted to flex outwardly away from one another to dispose said latch protrusions at latched positions beyond said opposite sides of said selected one platform extending into said slots in said side flanges of said selected one pair thereof when said selected one platform is inserted within said channel of said selected one pair of side flanges.

* * * * *